US005320116A

United States Patent [19]

Ackermann

[11] Patent Number: 5,320,116

[45] Date of Patent: Jun. 14, 1994

[54] COSMETIC COMPACT

[75] Inventor: Walter T. Ackermann, Watertown, Conn.

[73] Assignee: Risdon Corporation, Naugatuck, Conn.

[21] Appl. No.: 85,113

[22] Filed: Jul. 2, 1993

[51] Int. Cl.[5] ..... A45D 33/00

[52] U.S. Cl. ..... 132/293; 132/300; 132/303; 206/581; 206/823

[58] Field of Search ..... 132/286, 293, 294, 295, 132/296, 299, 300, 303, 314, 315; 206/581, 823; 220/324, 326

[56] References Cited

U.S. PATENT DOCUMENTS

| | | | |
|---|---|---|---|
| 1,597,378 | 8/1926 | Kendall | 132/303 |
| 1,626,613 | 5/1927 | Kendall | 132/303 |
| 1,987,533 | 1/1935 | Kreisler | 132/300 |
| 2,035,832 | 3/1936 | Parkin | 132/300 |
| 4,331,168 | 5/1982 | Hatakeyama | 206/581 |
| 4,799,503 | 1/1989 | Tahara | 206/823 |
| 4,901,882 | 2/1990 | Goncalves | 220/324 |
| 4,930,528 | 6/1990 | Hatakeyama | 132/293 |
| 5,199,451 | 4/1993 | Montoli | 132/314 |

FOREIGN PATENT DOCUMENTS

| | | | |
|---|---|---|---|
| 3141614 | 7/1982 | Fed. Rep. of Germany | 206/581 |
| 3626743 | 2/1987 | Fed. Rep. of Germany | 132/303 |

*Primary Examiner*—Gene Mancene
*Assistant Examiner*—Frank A. LaViola
*Attorney, Agent, or Firm*—Dallett Hoopes

[57] ABSTRACT

Compact has an unlatching slide with a button surface and formed with front and rear cam surfaces. The hinged cover is held closed by a detent and the powder tray is held in the base also by detents. Light finger pressure on the unlatching slide button causes the front cam to force up the hinged cover disengaging the cover detent to open the compact, and heavy finger pressure on the unlatching slide forces the powder tray up disengaging the tray detents and liberating the tray from the frame so that it may be replaced.

4 Claims, 2 Drawing Sheets

COSMETIC COMPACT

BACKGROUND OF THE INVENTION

1. Field of the Invention

This invention relates to a face powder compact. More specifically, the invention relates to a compact enclosing a powder tray and having a latch button which may, after unlatching the cover, be pressed harder to pop the powder tray up out of the base for replacement or refill.

2. Description of Related Art including Information Disclosed under §§1.97 to 1.99

There are many compacts disclosed by patents of the prior art.

An example is in U.S. Pat. No. 1,597,378 which issued Aug. 24, 1926 to W. G. Kendall. This patent shows a compact having a metal box-like base having an insert with a circular well normally holding a face powder tray. The base is provided with a hinged cover. A spring latch positioned in the front of the box is arranged to unlatch the cover upon a light press and to also drive the tray up out of the well upon a heavy press.

SUMMARY OF THE INVENTION

The present invention may be regarded as an improvement on the Kendall patent structure. Aside from the structure described above, the present invention includes an unlatching slide disposed reciprocably in the base and extending through a latch opening in the front of the base and toward the tray. The slide is provided with spring means and stop means for controlling its travel. The unlatching slide has a first cam surface adjacent its front end and a second cam surface adjacent its rear end. By virtue of the structure, pressing the slide will initially cause the first cam surface to engage the cover to unlatch it and ultimately cause the second cam surface to engage the underside of the tray to drive it up out of its position in its insert frame. The arrangement described is especially adapted for manufacture with molded plastic parts.

BRIEF DESCRIPTION OF THE DRAWINGS

Further objects and features of the invention will be apparent from the following specification and a study of the accompanying drawings, all of which disclose a non-limiting embodiment of the invention. In the drawings.

DESCRIPTION OF THE PREFERRED EMBODIMENT

Figure 1:
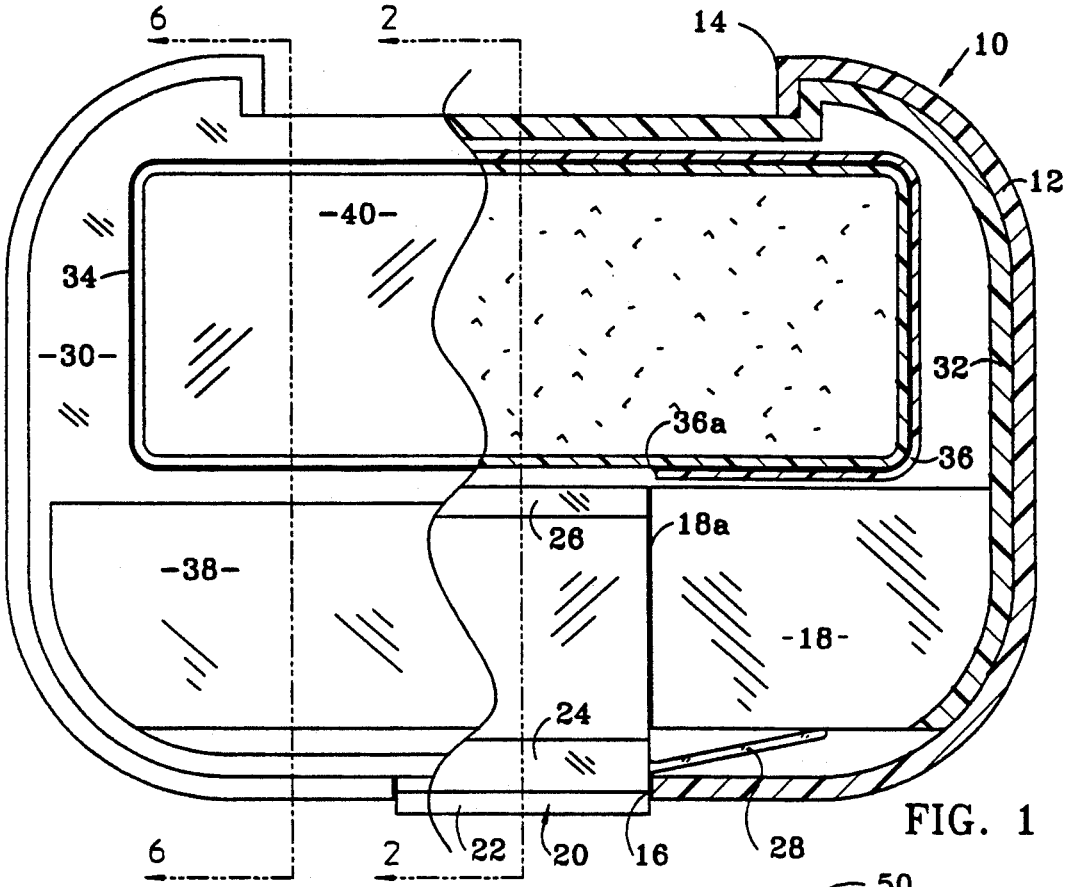
FIG. 1 is a top plan view of a compact embodying the invention with the cover removed and having the left hand side in section down to the level of the top of the unlatching slide.

A compact embodying the invention is generally designated 10 in FIG. 1. It comprises a base 12 having a floor and upward side walls about the periphery of the floor. The rear side wall is notched out and formed with inward flanges 14. The central portion of the front side wall of the base 12 is formed with a cutout 16. The floor is formed with a transverse upward broad rib 18. Rib 18 is interrupted centrally of the base to define downward centering surface 18*a* in alignment with the margins of the opening 16.

An unlatching slide 20 is provided. The slide is of one-piece molded plastic construction, resilient in thinner sections, and includes a thin main section and an upwardly enlarged front end defining a button surface 22, a downwardly inclined front cam 24 between the enlarged front end and the thin main section and a downwardly inclined rear cam 26 at the rear end. Integrally molded with the slide 20 are outward and inclined spring wings 28. These wings are disposed on each side of the slide 20 and are angled rearward as shown in FIG. 1, the distal ends of the wings engaging the front of the broad rib 18. The proximate ends serve as stop elements normally abuting the front wall of the base adjacent the opening 16 and thereby limiting the outward travel of the slide.

An insert frame 30 is provided. It is formed with downward peripheral thickened edges 32 which fit snugly inside the side walls of the base 12 and are sealed thereto. The frame is formed with a central opening 34 about which there is a depending circumferential fin means 36. The fin means are interrupted as at 36*a* in alignment with the slide 20. Forward of the opening the frame 30 is dished as at 38 to provide a compartment for a cosmetic brush or the like.

Figure 2:
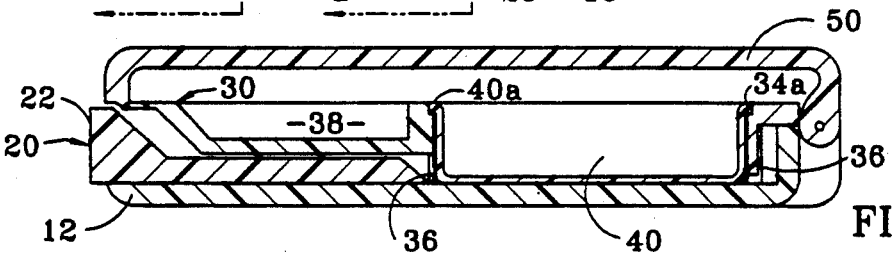
FIG. 2 is a sectional view taken on the line 2—2 of FIG. 1.

A cosmetic tray 40 is provided, its peripheral configuration conforming to the margins of the opening 34. The tray (FIG. 2) is an opened box-like structure preferably of molded plastic and has about its upper margin a small outer flange 40*a*. As shown in FIG. 2, the flange 40*a* fits into an inwardly stepped recess 34*a* about the opening 34.

Figure 7:
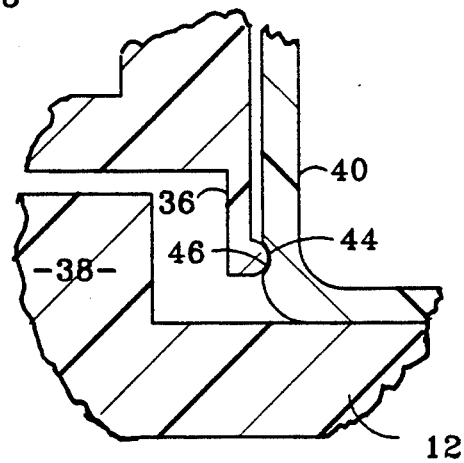
FIG. 7 is a greatly enlarged view of a portion of FIG. 6.
Figure 8:
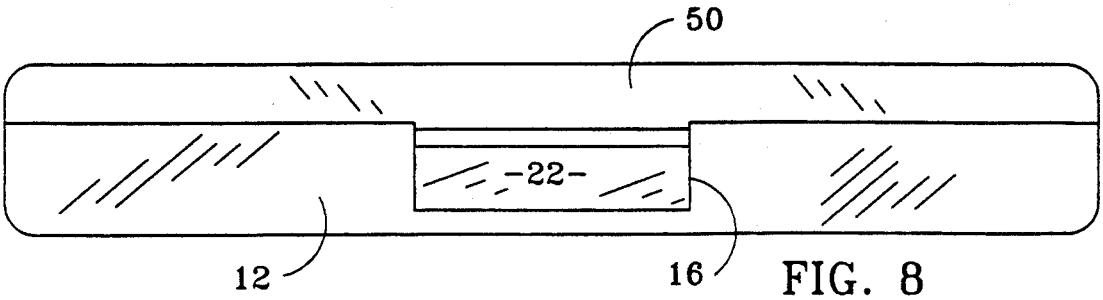
FIG. 8 is a front elevational view of the compact.

As shown in FIG. 7, the tray 40 may have an inward groove 44 about the lower portion of its side wall. The downward fin means of the frame about the opening 34 may carry an inward rib 46. It is to be noted that the lower portions of the flange about the opening in the frame 30 are relatively thin and, hence, resilient, the frame being molded of plastic similar to the plastic of the slide 20.

As the result of the structure described, when the tray 40, normally filled with a cosmetic such as rouge, is pressed into the frame 30 in assembly, the side walls move down until they bottom out, as shown in FIG. 7, on the floor of the base 12. At the same time the flange 40*a* nestles into the stepped recess 34*a* about opening 34 and the ribs 46 snap into the groove 44 to releasably hold the tray 40 in the frame 30.

Figure 3:
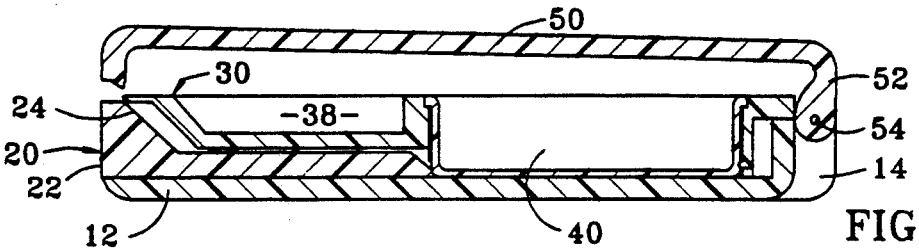
FIG. 3 is a view similar to FIG. 2 but having the slide partly depressed.

A hinged cover 50, which may be open box-shaped and inverted, is formed with a top wall and depending side walls to dimensionally correspond to the size and shape of the base 12. The rear side wall of the cover 50 is formed a downward knuckle 52, the knuckle 52 fitting between the flanges 14 (FIG. 1) and being pivotally attached thereto by pin means 54 (FIG. 3).

The front side wall of the cover 50 is formed with a downwardly inclined abutment surface 56 and the inside of the side wall adjacent the abutment surface is formed with a latching groove 58. The frame 30 is formed with a thin forward shelf 60, the forward edge of which is defined by a latching nose 62.

As a consequence of the cover and tray structure described, when the cover is closed, the thin resilient shelf 60 will yield, permitting the tip of the front side wall to pass by the nose 62 whereupon the nose snaps into the groove 58, releasingly latching the cover 50 closed. Upward force on the front side wall of the cover will permit the nose 62 to snap out of the groove 58 so that the cover may be opened.

The operation of the compact as described should already be apparent from the above description and drawings and the following narrative may be superfluous. However, the operation will now be described. When it is desired to open the compact, the user presses the button surface 22 urging the slide 20 inward. Front cam surface 24 engages the abutment surface 56 camming up the front of the cover 50 sufficiently so that the nose 62 breaks out of the groove 58, unlatching the cover. The user then has access to the tool on the dished-out portion 38 and can apply the cosmetic in the tray 40. The inside of the cover 50 may be provided with a mirror (not shown) as is conventional.

Figure 4:
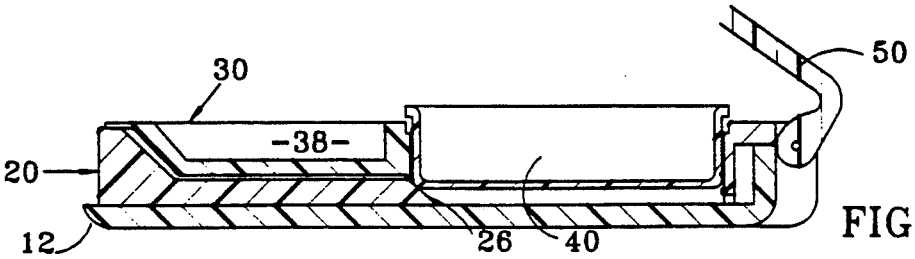
FIG. 4 is a view similar to FIG. 3 but having the slide further depressed and the cover shown only in fragment.

When it is desired to remove the tray 40, whether for reasons of replacement with a different color cosmetic or renewing the same cosmetic, the slide 20 may be pressed in farther against the action of the spring wings 28. As it is pressed in farther, the rear cam 26 noses under the tray 40 (FIG. 4) and raises the front of the tray 40 upward, snapping the groove 44 up out of engagement with the ribs 46. Once the tray 40 is partly up out of its opening 34 in the frame 30, it may be grasped by the user and completely removed. A new tray having the same dimensions as the old tray, with either the same or different contents, may be placed in the opening 34 and pressed downward until the ribs 46 snap into the grooves 44 as described above.

Figure 5:
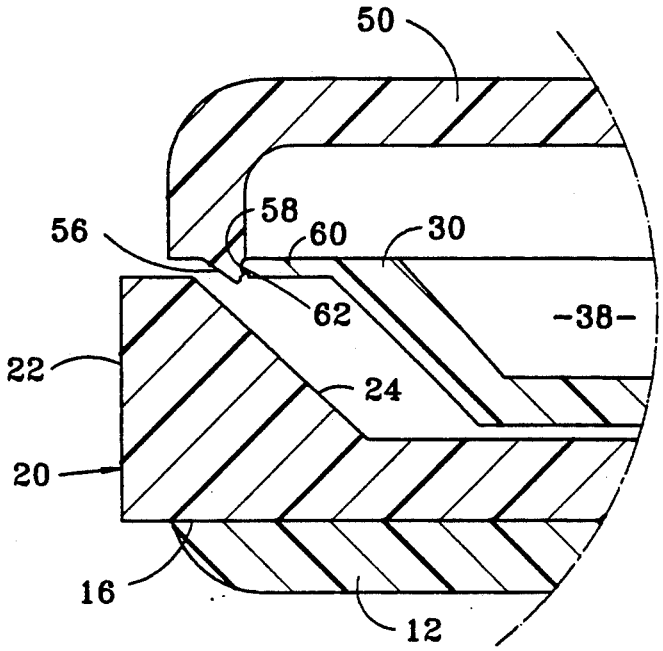
FIG. 5 is a greatly enlarged view of a part of FIG. 2 showing the latching detent.
Figure 6:
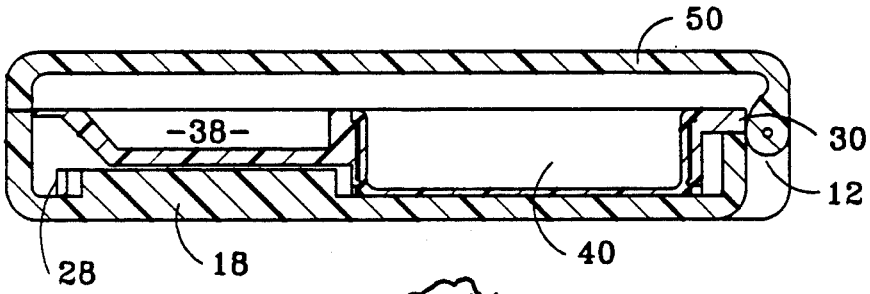
FIG. 6 is a sectional view taken on the line 6—6 of FIG. 1.

When it is desired to close the compact, the cover 50 is merely squeezed against the base 12 so that the inner surface of the front side wall flexes the shelf 60 (FIG. 5) downward until the nose 62 snaps into the groove 58 to hold the cover latched as described above.

As described, the parts of the compact of the invention are preferably all molded of plastic. This may be a durable plastic such as polypropylene capable of heat sealing, as the frame is sealed to the base.

Further variations in the design are possible. For instance, the hinge described may, if the plastic of the compant is, for instance, polypropylene, be redesigned as a "living hinge" to simplify the assembly of the unit and reduce the number of parts.

It should be understood that the invention is not limited to the embodiment shown but the invention is instead defined by the scope of the following claim language, expanded by an extension of the right to exclude as is appropriate under the doctrine of equivalents.

What is claimed is:

1. A cosmetic compact comprising:

a. a base having a bottom wall with upward sidewalls about the periphery of the bottom wall, the base having a latch aperture in its front sidewall, b. a cover hinged at its rear to the base and having at its front a latching detent, c. an insert frame having a tray-receiving opening therein defined by a margin, the insert frame having its periphery secured to the sidewalls of the base, downward resilient fin means about the margin of the opening and inward ribs at the bottom of the fin means, the insert frame having detent-engaging means in the front in alignment with the latching detent on the cover so that when the cover is closed, the detent and detent-engaging means releaseably interfit to latch the cover closed, the fin means being interrupted in alignment with the latch aperture, d. a cosmetic tray having a floor with an upward sidewall about the periphery of the floor and removably disposed in the tray-receiving opening, the tray having grooves in its sidewall, the ribs and grooves interfitting to releaseably hold the tray in position in the insert frame, e. a one-piece molded unlatching slide having front and rear ends and disposed reciprocably in the base and extending through the latch aperture toward the tray, the unlatching slide having a thin main section and an upwardly enlarged front end defining a button surface, a downwardly inclined first cam between the enlarged front end and the main section and a downwardly inclined second cam at the rear end, f. means biasing the unlatching slide toward the front of the base whereby moving the unlatching slide toward the rear will cause the first cam surface to engage the cover and drive it upward disengaging the detent and detent-engaging means to unlatch the cover, and further moving the unlatching slide will cause the second cam surface to engage under the tray to disengage the ribs and grooves and drive the tray up out of the insert for replacement.

2. A cosmetic compact as claimed in claim 1 wherein the means biasing the unlatching slide forward are spring wings which are integral with the slide and engage a part of the base.

3. A cosmetic compact as claimed in claim 1 wherein the base has an upward transverse rib which is interrupted to present parallel opposed centering surfaces which guide the movement of the unlatching slide.

4. A cosmetic compact comprising:

a. a base having a bottom wall with upward sidewalls about the periphery of the bottom wall, the base having a latch aperture in its front sidewall, b. a cover hinged at its rear to the base and having at its front a latching detent, c. an insert frame having a tray-receiving opening therein defined by a margin, the insert frame having its periphery secured to the sidewalls of the base, releaseable tray-retaining means adjacent the margin of the opening, the insert frame having detent-engaging means in the front in alignment with the latching detent on the cover so that when the cover is closed, the detent and detent-engaging means releaseably interfit to latch the cover closed, d. a cosmetic tray having a floor with an upward sidewall about the periphery of the floor and removably disposed in the tray-receiving opening and releaseably held in position in the opening by the releaseable tray-retaining means, e. a one-piece molded unlatching slide having front and rear ends and disposed reciprocably in the base and extending through the latch aperture toward the tray, the unlatching slide having a thin main section and an upwardly enlarged front end defining a button surface, a downwardly inclined first cam between the enlarged front end and on the main section and a downwardly inclined second cam at the rear end, f. means biasing the unlatching slide toward the front of the base whereby moving the unlatching slide toward the rear will cause the first cam surface to engage the cover and drive it upward disengaging the detent and detent-engaging means to unlatch the cover, and further moving the unlatching slide will cause the second cam surface to engage under the tray to release the releaseable tray-retaining means.

* * * * *